US010035321B2

(12) United States Patent
Stahlecker et al.

(10) Patent No.: US 10,035,321 B2
(45) Date of Patent: Jul. 31, 2018

(54) METHOD FOR MANUFACTURING A CONICAL SLEEVE AND/OR A PAPER CUP

(71) Applicants: Werner Stahlecker, Goeppingen (DE); Uwe Messerschmid, Albershausen (DE)

(72) Inventors: Werner Stahlecker, Goeppingen (DE); Uwe Messerschmid, Albershausen (DE)

(73) Assignee: MICHAEL HOERAUF MASCHINENFABRIK GMBH & CO. KG, Donzdorf (DE)

( * ) Notice: Subject to any disclaimer, the term of this patent is extended or adjusted under 35 U.S.C. 154(b) by 904 days.

(21) Appl. No.: 14/147,740

(22) Filed: Jan. 6, 2014

(65) Prior Publication Data

US 2014/0121087 A1 May 1, 2014

Related U.S. Application Data

(63) Continuation of application No. 12/151,246, filed on May 5, 2008.

(30) Foreign Application Priority Data

May 11, 2007 (EP) ..... 07009551

(51) Int. Cl.
*B31D 5/00* (2017.01)
*B65D 3/22* (2006.01)
(Continued)

(52) U.S. Cl.
CPC ..... *B31D 5/0086* (2013.01); *B65D 3/22* (2013.01); *B31B 50/0014* (2017.08);
(Continued)

(58) Field of Classification Search
CPC ..... B31B 1/32; B31B 15/00; B31B 17/00; B31B 49/00; B31B 2201/226;
(Continued)

(56) References Cited

U.S. PATENT DOCUMENTS 2,819,659 A 1/1958 Scott et al.
3,490,575 A * 1/1970 Herrmann ..... B65G 29/00 198/377.01

(Continued)

FOREIGN PATENT DOCUMENTS

CN 1489541 A 4/2004
DE 1 778 253 7/1971

(Continued)

OTHER PUBLICATIONS

Office Action of Korean Patent Office issued in Application No. 10-2008-0036931 with English translation dated Jun. 23, 2014 (8 pages).

(Continued)

*Primary Examiner* — Sameh Tawfik
(74) *Attorney, Agent, or Firm* — Flynn, Thiel, Boutell & Tanis, P.C.

(57) ABSTRACT

An apparatus for manufacturing a sleeve for a paper cup and/or a paper cup comprises a machine frame and at least two star wheels, which are rotatably connected with the machine frame and which can be rotated in synchronized cycles. A first star wheel comprises a number of conical mandrels, on each of which one sleeve made of a flat-lying blank can be formed. The star wheels are positioned in one plane and are arranged to a vertical wall of the machine frame with horizontal rotary axes. The star wheels can be connected to at least one drive, whereby the drive is arranged on the side of the machine frame wall facing away from the star wheels.

16 Claims, 2 Drawing Sheets

(51) Int. Cl.

| | |
|---|---|
| *B31B 50/32* | (2017.01) |
| *B31B 105/00* | (2017.01) |
| *B31B 50/00* | (2017.01) |
| *B31B 110/10* | (2017.01) |
| *B31B 120/50* | (2017.01) |

(52) U.S. Cl.
CPC ..... *B31B 50/32* (2017.08); *B31B 2105/00* (2017.08); *B31B 2105/0022* (2017.08); *B31B 2110/10* (2017.08); *B31B 2120/501* (2017.08)

(58) Field of Classification Search
CPC ..... B31B 2201/2612; B31B 2217/003; B31B 2217/062; B31B 2217/082; B31D 5/0086; B65D 3/22
USPC ..... 493/106
See application file for complete search history.

(56) References Cited

U.S. PATENT DOCUMENTS

| | | | | | |
|---|---|---|---|---|---|
| 3,724,339 | A * | 4/1973 | Metzinger | A24C 5/474 | 29/564.1 |
| 3,990,353 | A | 11/1976 | Richards et al. | | |
| 4,100,842 | A | 7/1978 | Richards et al. | | |
| 4,208,955 | A * | 6/1980 | Doll | B31B 1/28 | 493/102 |
| 4,452,596 | A * | 6/1984 | Clauss | B31B 17/00 | 493/107 |
| 4,490,130 | A | 12/1984 | Konzal et al. | | |
| 4,547,645 | A * | 10/1985 | Smith | B21D 51/2676 | 198/403 |
| 4,790,123 | A * | 12/1988 | Ljungstrom | B31B 3/00 | 53/202 |
| 5,678,385 | A * | 10/1997 | Focke | B65B 19/02 | 53/148 |
| 5,752,907 | A * | 5/1998 | Konzal | B31B 17/00 | 493/106 |
| 5,829,228 | A * | 11/1998 | Mogard | B31B 1/28 | 493/105 |
| 585,131 | A1 | 1/2004 | Stahlecker et al. | | |
| 6,676,585 | B1 * | 1/2004 | Stahlecker | B31B 1/32 | 493/102 |
| 7,090,630 | B2 * | 8/2006 | Boldrini | B31B 1/64 | 493/175 |
| 7,100,770 | B2 | 9/2006 | D'Amato | | |
| 7,614,993 | B2 * | 11/2009 | Van Handel | B29C 61/02 | 493/153 |
| 2004/0094612 | A1 | 5/2004 | D'Amato | | |
| 2006/0186012 | A1 | 8/2006 | D'Amato | | |
| 2008/0277460 | A1 | 11/2008 | Mohn et al. | | |

FOREIGN PATENT DOCUMENTS

| | | | |
|---|---|---|---|
| DE | 195 17 394 | A1 | 11/1996 |
| DE | 197 26 215 | A1 | 12/1998 |
| EP | 1 227 042 | A1 | 7/2002 |
| JP | 5-71110 | | 9/1993 |
| JP | 6-71790 | | 3/1994 |
| JP | 8337236 | A | 12/1996 |
| JP | 2001-192015 | | 7/2001 |
| KR | 1995-0009967 | | 4/1994 |
| WO | 99/11526 | | 3/1999 |

OTHER PUBLICATIONS

European Patent Office Search Report dated Oct. 8, 2007.
Office Action of China Patent Office dated Mar. 9, 2011 with English Translation.
Office Action of Korean Patent Office issued in Application No. 10-2008-0036931 with English translation dated Feb. 11, 2015 (10 pages).

* cited by examiner

METHOD FOR MANUFACTURING A CONICAL SLEEVE AND/OR A PAPER CUP

CROSS REFERENCE TO RELATED APPLICATION

This is a continuation of prior U.S. application Ser. No. 12/151,246, filed May 5, 2008, the disclosure of which is hereby incorporated by reference herein.

BACKGROUND AND SUMMARY OF THE INVENTION

The present invention relates to an apparatus for producing a conical sleeve for a cup and/or a conical paper cup having a machine frame and at least two star wheels which are rotatably connected with the machine frame and which are driveable in synchronized cycles, whereby the first star wheel comprises a number of conical mandrels, on each of which a sleeve can be formed from a flat-lying blank.

An apparatus of this type is prior art in International Patent Application WO 99/11526 A1. The construction of the known apparatus is very complicated and convoluted. The star wheels have differently arranged rotary axes, which are placed perpendicular to one another. The star wheels are also placed in different planes. Because of this, the transfer of the sleeve or of the paper cup from one star wheel to another is difficult. In addition, it is also difficult for a machine operator to access the processing stations on the star wheels. A conversion of the apparatus to another cup format is very complicated. Furthermore, access to the drives is poor, as the drives are mounted below the star wheels having vertically arranged drive shafts.

It is an object of the present invention to improve an apparatus of the above mentioned type.

This object has been achieved in accordance with the present invention in that the star wheels are disposed in one plane and are arranged to a vertical wall of the machine frame by means of horizontal drive shafts.

An arrangement of the star wheels such as this in the apparatus permits very good accessibility to the individual processing stations on the star wheels. A machine operator can view all star wheels very easily and can easily eliminate any faults which may occur.

The star wheels are advantageously connected to at least one drive, whereby the drive is arranged to the central wall of the machine frame on the side facing away from the star wheels. This has the advantage in that the drives are also very easily accessible from the back side of the machine in the case of operational failure. The drives can be very simply designed and are at the same time precise, as there are only short paths from the drive to the star wheel. In order to achieve the presently required cyclical speed of the machine of over 250 cycles per minute with good positional exactness of the star wheels, a very rigid and stable machine frame and drive construction is necessary due to the high accelerations and the mass inertia forces arising therefrom. The central wall of the machine frame guarantees a high level of stability and rigidity.

Sufficient space also exists on the back side of the machine to take up drives, which inevitably have relatively large dimensions due to the mass inertia forces. In contrast to the above mentioned prior art, where available space below the star wheel, which is arranged with a vertical axis of rotation, is limited, the space for the drives in the case of the present invention is not limited, as the position and accessibility of the star wheels is totally independent of the size of the drive.

At the same time, a very high level of precision of the production apparatus can be achieved by means of the central wall of the machine frame, as the central wall provides the assembly positions of the drives, the star wheels and the processing stations. No further frame parts are necessary, which impair the exactness with additional tolerances. The central wall of the machine frame can for example be made as a one-piece cast part, which can be machined completely on one machine tool, so that all bore holes and supporting surfaces possess a high level of positional accuracy in relation to one another.

The drives can be designed differently. For a very high level of rigidity and stability, for example, so-called indexing gear boxes are advantageous, in which a continuous rotational motion of a drive motor is converted into a cyclical rotational motion of the star wheel via a worm shaft having a changing pitch. It can also be advantageous to position the rotational axes of the drives parallel to the rotational axes of the drive shafts of the star wheels. A deflection of the rotational direction is then no longer necessary.

Advantageously the star wheels are fixed to the machine frame in a way which permits easy replacement of the wheels. For this purpose, easily releaseable means for connection with the drive, for example quick-action connectors, are provided. The apparatus can thus be converted very quickly to another cup format. For example a complete star wheel can be removed from the apparatus in very little time and be replaced by a star wheel prepared for a different cup format. Production loss during conversion of the machine is hereby minimised.

The apparatus according to the present invention is suited for manufacturing various types of cup, which can have round or optional shaped cross-sections. For example, one-walled paper cups from coated or uncoated paper or paperboard can be produced. A thin plastic layer is particularly suitable as a coating, which renders the paper material liquid-tight and which can be applied to one or both sides of the paper material. The arrangement according to the present invention is also very well suited for producing conical sleeves for various types of cup. The sleeves are formed from a pre-cut blank, for example of paper or paperboard, in that they are wound around a conical mandrel and joined together along their longitudinal side. The manufactured sleeves can for example form the outer sleeve of double-walled insulated cups or of plastic cups. They can also be placed in an injection mould to form the outer sleeve surface of a plastic cup. The plastic cup can hereby consist for example of a foamed plastic material.

The joining of the individual parts of the cup can take place in a variety of ways and is dependent on the types of material being joined and the requirements. Joining can for example take place by means of hot sealing, gluing with hot or cold glue or also by means of hot-melt-adhesives. When in the case of the present invention the word "joining" is mentioned, it always refers to any one of the above mentioned possibilities.

A separating device for feeding single blanks from a stack of blanks is assigned to the first star wheel of the apparatus is. The individual blanks are placed around the conical mandrel of the first star wheel and form thus a sleeve for a cup or directly the wall of a paper cup. When the blank is to form the wall of a paper cup, for example a one-walled paper cup or an inner cup for a double-walled insulating cup, it is advantageous to place to the first star wheel a device for forming a cup bottom, for example in the form of a bottom press, which feeds pre-formed cup bottoms to the mandrels of the first star wheel, which cup bottoms then are joined to the sleeve formed on the mandrel.

It is advantageous that the first star wheel is arranged to a second star wheel, which comprises a number of hollow mandrels, the insides of which can take up the paper cups and/or the formed sleeves. This causes the rim at end of the sleeve with the larger diameter to become freely accessible and this edge can then be processed according to requirements, for example an outwardly formed lip or a shoulder can be provided. The star wheels are arranged to one another in such a way that the paper cup and/or the sleeve can be transferred in a linear movement directly from one star wheel to the next star wheel. The transfer device can be very simply designed, for example by means of a simple blower nozzle. The simple linear movement over a short distance permits a reliable transfer even at high cycle rates.

In an embodiment of the present invention, the arrangement is particularly suitable for manufacturing a double-walled insulating cup made of paper or paperboard. Advantageously at least three star wheels are provided for the purpose. On the first star wheel, a sleeve is formed from a flat-lying blank, which sleeve is then transferred to the second star wheel. The third star wheel takes up pre-formed paper cups, in which a sleeve is already securely adhered to a bottom, for example from a cup magazine or direct from another cup-manufacturing machine. A cup magazine can also be provided as an intermediate storage device in the case of a cup-manufacturing machine arranged upstream thereof. A forming device for a means for stacking can be arranged to this third star wheel. The forming device forms a means for stacking, for example a bead or a shoulder in the sleeve of the paper cup. The paper cup is transferred from the third star wheel to the second star wheel and inserted in the sleeve and joined thereto. After the last processing station of the second star wheel a double-walled paper cup has been formed which possesses good insulating properties.

In an alternative embodiment of the present invention, the third star wheel can be used for feeding a finished plastic cup from a cup magazine. On the first star wheel a sleeve is in turn formed from paper material, where it can also be alternatively provided with a bottom, and transferred to the second star wheel. The plastic inner cup is transferred from the third star wheel to the second star wheel and inserted hereby into the paper outer sleeve or the outer cup.

In a further embodiment of the present invention a fourth star wheel can be provided, which is arranged downstream of the second star wheel and which again comprises conical mandrels, on which the double-walled cup, provided with the sleeve, is taken up. In the processing stations arranged to the fourth star wheel, finishing work can be carried out, for example in the area of the paper cup in which the bottom is secured, for example in order to improve the design or the stacking properties of the cup. The stacking properties of the double-walled cup can for example be improved in that the area of a skirt is radially widened in a processing station of the fourth star wheel.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Because of its modular design, the apparatus of the present invention is very flexible regarding the production of widely varying types of paper cups or conical sleeves for cups. With the aid of the paper cup 51 shown in FIG. 3, an advantageous embodiment of the manufacturing apparatus is described.

Figure 3:
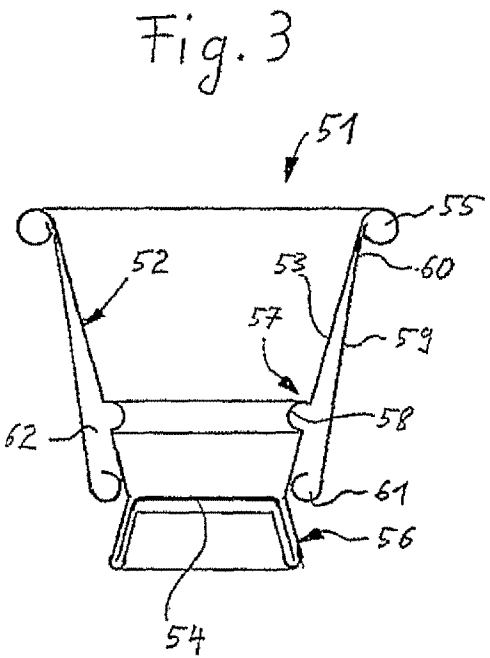
FIG. 3 is an example of paper cup manufactured by the apparatus of the present invention.

The paper cup 51 shown in FIG. 3 is formed from a paper material, which is provided on at least one side with a thin coating, advantageously a polyethylene coating. The paper cup 51 is designed as a double-walled insulating cup, which is particularly practical for hot food or drinks, for example coffee or Chinese noodle dishes. Because of the insulation, the cup 51, even while containing hot substances, can be held in the hand without difficulty over a longer period of time. The paper cup 51 essentially comprises an inner paper cup 52, which consists of a conical sleeve 53 and a bottom 54 joined thereto. The sleeve 53 comprises at its top end an outwardly rolled lip 55. At a lower end, the sleeve 53 is sealed by means of a skirt 56 with the bottom 54 in a liquid-tight manner. In the middle area of the sleeve, means 57 for stacking a number of identical cups 51 can be arranged. In the shown case, the means 57 for stacking is formed in the sleeve 53 of the inner paper cup 52 as an inwardly projecting rib 58. Alternatively the means 57 for stacking can be designed differently, for example by means of a shoulder or bead, and can of course be formed outwards. A conical sleeve 59 is arranged to the inner paper cup 52, which for example can have a somewhat different taper angle. The sleeve 59 is glued or sealed with its top end 60 in the area below the lip 55 to the paper cup 52. The sleeve 59 is provided at its lower end with an inwardly curled-in part 61, which sleeve 59 sits on the sleeve 53 with this curled-in part 61. Between the sleeve 59 and the sleeve 53, an insulating annular space 62 is formed. To improve the insulating effect, shoulders could be provided on the sleeve 53 or on the sleeve 59 (in a variation not shown), at which shoulders the diameter of the sleeve abruptly increases or decreases in size.

Subsequent to the joining process of the inner paper cup 52 and the sleeve 59 and the sealing, the skirt 56 is widened at least in its lower area, so that it extends conically opposed to the sleeve 53 of the paper cup 52. The skirt 56 can thus act together with the stacking means 57 when a number of identical double-walled paper cups 51 are stacked together and ensure that the paper cup 51 is reliably stacked and can be de-stacked without jamming. The rib 58 supports hereby the following cup in the stack on its widened skirt 56. The cups cannot become jammed between the outer side of the sleeve 59 and the inner side of the sleeve 53 of the stacked paper cup 51, as advantageously no contact at all takes place in this area between the cups.

The "conical" feature of the sleeve 53 and the sleeve 59 should be understood as a tapering of the sleeve 53 and the sleeve 59, in the longitudinal section shown in FIG. 3, from the lip 55 to the bottom 54. The form of the sleeve 53 and the sleeve 59 in cross section is not of any significance. The paper cup 51 can be, for example round, oval or even rectangular with rounded corners in cross section. The paper cup 51 has, in the case of a round cross section of the conical sleeve 53, a truncated cone-like shape, whereas in the case of a rectangular cross section of the conical sleeve 53, the paper cup 51 has a rather truncated pyramid-like form. Paper cups 51 having a non-round cross section are often referred to as "form cups".

Figure 1:
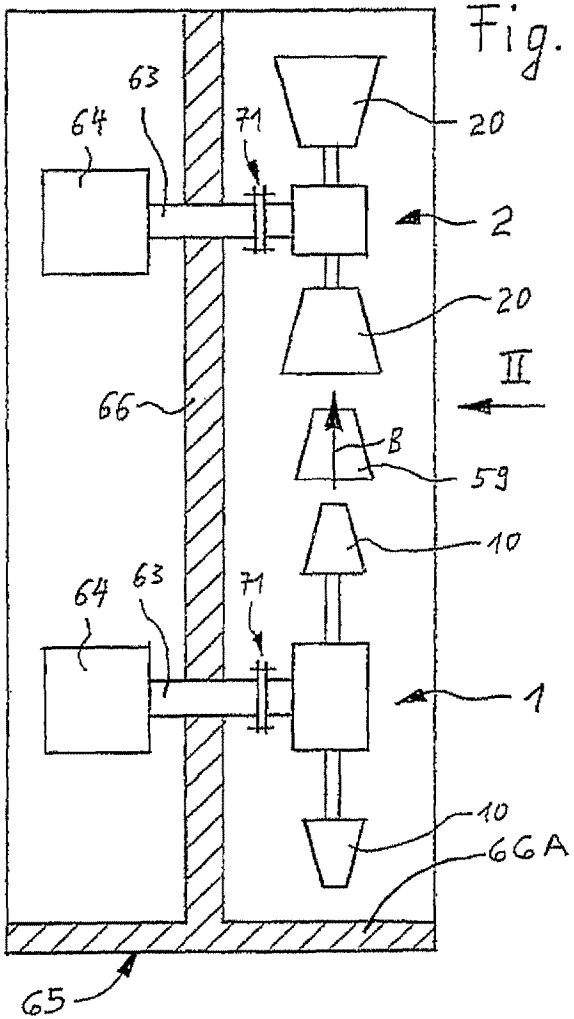
FIG. 1 is a very schematic and not to scale side view of an apparatus for manufacturing double-walled insulating cups.
Figure 2:
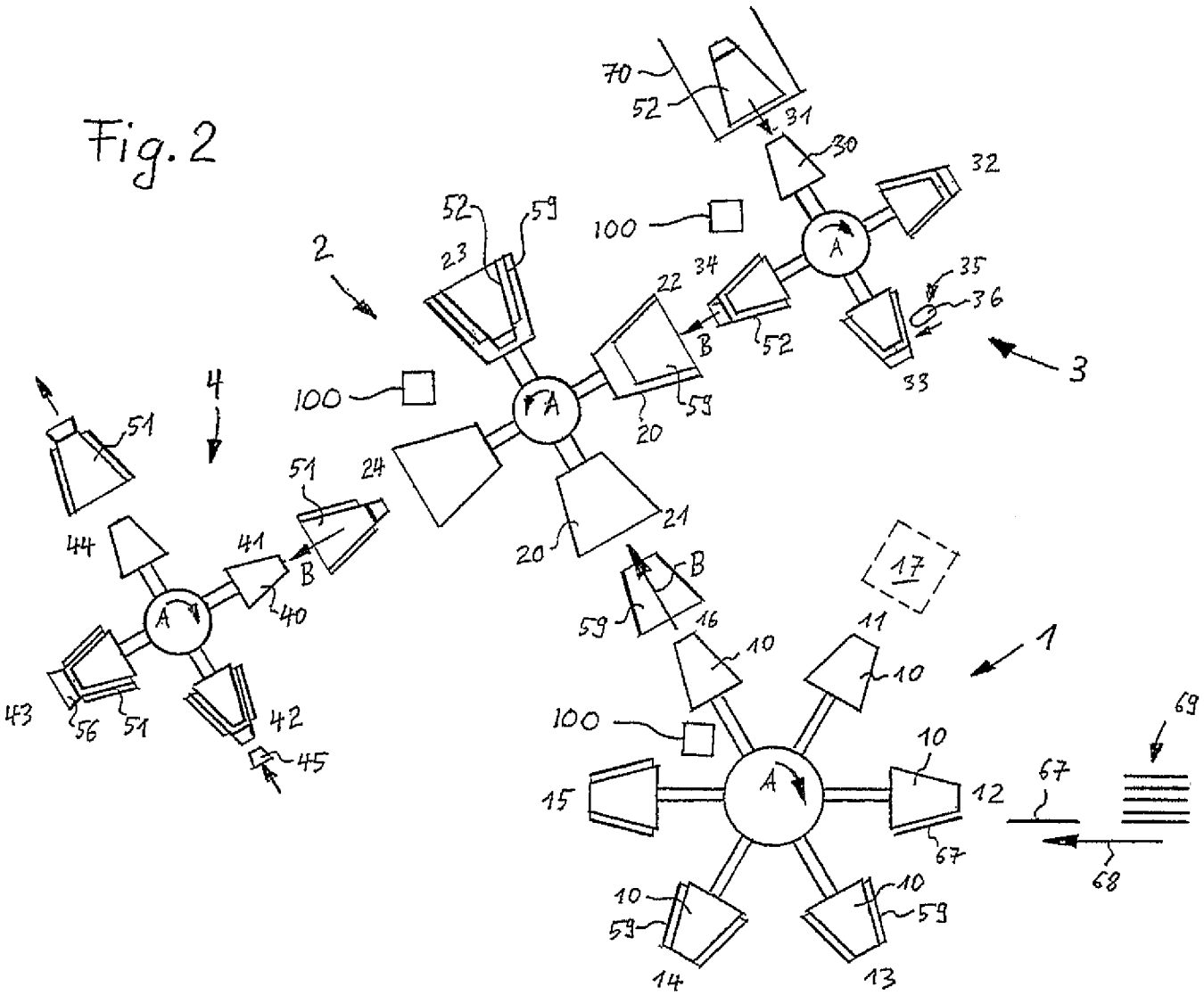
FIG. 2 is a view in the direction of the arrow II of the apparatus of FIG. 1.

With the aid of FIGS. 1 and 2, the apparatus for manufacturing a paper cup 51 is described below.

The apparatus consists essentially of four so-called star wheels, 1, 2, 3, 4 on each of which are arranged a number of mandrels 10, 20, 30 and 40 in a star-shaped way. The number of mandrels 10, 20, 30 and 40 can vary depending on the number of necessary procedural steps. The star wheels 1, 2, 3 and 4 each sit on a drive shaft 63 and are driveable by at least one drive 64 in cycles in rotational direction of the arrows A. The rotational directions A are merely examples and can also be in the opposite direction. The apparatus comprises a machine frame 65 having a central vertical wall 66. The star wheels 1, 2, 3, 4 are arranged on the vertical wall 66 in such a way that the rotational axes of the drive shafts 63 all lie horizontally and parallel to one another. The star wheels 1, 2, 3, 4, with their mandrels 10, 20, 30, 40 can as a result all lie in one plane. This is can be seen very clearly in FIG. 1 in the case of the star wheels 1 and 2. The drives 64 for the star wheels 1, 2, 3, 4 are arranged on the side of the vertical wall 66 of the machine frame facing away from the star wheels 1, 2, 3, 4. As a result, the star wheels 1, 2, 3, 4, as well as the drives 64, can be accessed very easily. The drives can be advantageously formed by indexing gear boxes.

The star wheel 1 comprises in the shown example six conical mandrels 10; a processing station 11, 12, 13, 14, 15, 16 can be assigned to each mandrel 10. Processing stations 11 that are not required can remain empty. In working cycles of the apparatus, the drive 64 turns the star wheel 1 further by 60°, so that each mandrel 10 reaches the respective subsequent processing station. Flat-lying blanks 67 are fed to the star wheel 1 in the processing station 12, which blanks 67 are fed by the separating device, denoted by the arrow 68, from a stack of blanks 69. The flat-lying blank 67 is wrapped around the conical mandrel 10 in the subsequent processing stations 13, 14, and 15, sealed on its longitudinal side and provided with a curled-in part 61, and forms then a conical sleeve 59. For illustrative reasons, the curled-in part 61 of the sleeve 59 is not shown in FIGS. 1 and 2. In the processing station 16, the finished sleeve 59 is transferred in arrow direction B to a hollow mandrel 20 of the second star wheel 2. The hollow mandrel 20 takes the sleeve 59 up from the outside. In the moment of transferral, the hollow mandrel 20 in the processing station 21 is arranged exactly co-axially to the conical mandrel 10 of the processing station 16. The sleeve 59 can be transferred as a result in a linear movement directly from the star wheel 1 onto the star wheel 2. The transfer in arrow direction B can for example take place very easily by means of blower jets.

In the next processing cycle, the sleeve 59 is transported further by means of the rotation A of the star wheel 2 in the processing station 22. In the processing station 22 a prefabricated inner paper cup 52 is inserted into the sleeve 59. The paper cup 52 is prepared by a third star wheel 3 and transferred again from the processing station 34 in a linear movement B to the processing station 22.

It is advantageous to feed prefabricated paper cups 52 or prefabricated plastic cups, for example via a cup magazine 70 as a temporary storage, to the star wheel 3. The paper cup 52 can be prefabricated to the stage where only the means 57 for stacking have yet to be added, and where a lip 55 is already present. The lip 55 in FIG. 2 has again been omitted for illustration reasons. It is advantageous to apply the means 57 for stacking only at a processing station 33 of the third star wheel 3, as the paper cup 52 can be then produced on a standard cup machine which does not need to comprise any special devices. The forming device 35 for the means 57 for stacking the double-walled insulating cup 51 is integrated into the production device for the sleeve 59 and can as a result be adapted optimally to the shape of the sleeve 59. Standard inner paper cups 52 can be provided as a result with various shaped sleeves 59. This increases the flexibility of the manufacturers of double-walled paper cups 51.

The forming device 35 for the means 57 for stacking can be designed in various ways. In FIG. 2, a circulating roll 36 is shown, which can be placed radially to the paper cup 52 sitting on the mandrel 30, in order to form the inwardly projecting rib 58. Alternatively, radially positionable press jaws can of course be provided from the inside or the outside.

The inner cup 52 which is inserted into the sleeve 59 in the processing station 22 is transported further in a subsequent procedural step to the processing station 23 and joined there to the sleeve 59. Depending on the design of the stacking means 57, the production of the paper cup 51 can be completed already in the processing station 24 and transported out of the apparatus. A fourth star wheel 4 can be provided as an option, to which star wheel 4 the paper cup 51 is transferred from the processing station 24 in arrow direction B. The star wheel 4 in turn comprises conical mandrels 40, which take up the paper cup 51 from the inside. A forming device 45 can for example be assigned to the star wheel in the processing station 42, with which device 45 the skirt 56 can be widened. The widened skirt 56 serves, as described above, to improve the stacking properties of the paper cup 51. The double-walled paper cup 51 is finally completed in the processing station 44 and can be removed from the apparatus.

If the paper cup 51 made in the described production apparatus is a so-called form cup, then it can be advantageous to assign a rotating device (in a way not shown) to the conical mandrels 30 of the star wheel 3, with which rotating device each mandrel 30 can be turned to a certain degree around its longitudinal axis. If in the production of form cups an inner cup 52 with a non-round cross section is removed from the cup magazine 70 in any direction and placed in the processing station 31 onto a conical mandrel 30 having a circular cross section, then a subsequent alignment of the inner cup 52 is necessary. This problem occurs in particular when the inner cup 52 has a circular cross section at its lip 55 and an oval cross section or an essentially rectangular cross section at its bottom 54. The sleeves 59 formed on the star wheel 1 sit in the hollow mandrels 20 of the star wheel 2 in a defined direction. The form of the hollow mandrel 20 can also be non-round and adapted to the form of the sleeve 59. In order that the inner cup 52 is positioned in the correct direction in the processing station 34 and can be transferred, fitting exactly, to the sleeve 59 sitting in the processing station 22, the mandrel 30 is turned by the rotational device around its longitudinal axis and the inner cup 52 is aligned. In order that the inner cup 52 does not slip on the mandrel 30, a suction or nipping device can be assigned to each mandrel 30 (in a way not shown). A sensor (not shown) can for example be assigned to the rotating device in the processing station 32, which sensor records the position of the inner cup 52, preferably without contact, and signals the rotating device how far the mandrel 30 comprising the inner cup 52 has to be turned around its longitudinal axis.

By means of the production apparatus described, a very high level of flexibility and a very low level of idle time during the format change and alterations to the cup design are achieved. The good accessibility of the star wheels 1, 2, 3 and 4 as a result of the arrangement on the vertical wall 66 of the machine frame 65 permits for example also the rapid exchange of a complete star wheel 1, 2, 3, and 4 for a star wheel for another cup form. The star wheels 1, 2, 3, and 4 are therefore preferably in an overhung position and affixed to the machine frame 65 in an easily exchangeable manner. Easily releaseable means 71 for connecting with the drive 64 can be provided at the drive shafts 63, for example in the form of quick action couplings.

The production apparatus can be very easily modified. For example, in an embodiment not shown, an apparatus with only two star wheels 1 and 2 for the production of one-walled cups can be applied. In this case, for example, a bottom press 17 can be arranged to the processing station 11 of the first star wheel 1, which bottom press 17 presses out a cup bottom similar to the bottom 54 and transfers said cup bottom to the mandrel 10 in the processing station 11. The sleeve 59 can then be joined with this bottom in one of the processing stations 13 to 15. In the second star wheel 2, a lip 55 for example can be formed in the one-walled paper cup.

The invention claimed is:

1. A method of making a double walled cup comprising:
providing a machine frame;
rotatably connecting at least three star wheels with the machine frame;
driving the at least three star wheels with synchronized cycles;
providing a first of the at least three star wheels with a plurality of conical mandrels;
providing a flat-lying blank;
forming a sleeve without a bottom from the flat-lying blank with the plurality of conical mandrels of the first of the at least three star wheels;
positioning the at least three star wheels on one plane;
supporting the at least three star wheels with horizontal drive shafts on a vertical wall of the machine frame;
transferring the sleeve from the first of the at least three star wheels to a second of the at least three star wheels with a transfer device;
arranging the at least three star wheels in relation to one another in such a way that the sleeve is transferable in a linear movement directly from one star wheel to another star wheel by the transfer device;
applying a cup into the sleeve at the second of the least three star wheels;
transferring the cup from a third of the at least three star wheels to the second of the at least three star wheels; and
feeding the cup to the third of the at least three star wheels via a cup magazine for temporary storage.

2. The method of making the double walled cup according to claim 1, further including:
assigning a separating device to the first of the at least three star wheels; and
feeding the flat-lying blank from a stack of blanks to the first of the at least three star wheels with the separating device.

3. The method of making the double walled cup according to claim 1, wherein:
the second of the at least three star wheels comprises a number of hollow mandrels, each hollow mandrel having an interior configured to take up the cup and the sleeve.

4. The method of making the double walled cup according to claim 1, further including:
connecting the at least three star wheels to at least one drive; and
arranging the at least one drive on a side of the vertical wall of the machine frame facing away from the at least three star wheels.

5. The method of making the double walled cup according to claim 1, further including:
assigning forming devices for forming means for stacking in a portion of the cup to the third of the at least three star wheels.

6. The method of making the double walled cup according to claim 1, further including:
providing a fourth of the at least three star wheels;
arranging the fourth of the at least three star wheels downstream of the second of the at least three star wheels;
providing the fourth of the at least three star wheels with conical mandrels; and
taking up the cup provided with the sleeve on the conical mandrels of the fourth of the at least three star wheels.

7. The method of making the double walled cup according to claim 6, further including:
widening a skirt of the cup with a forming device; and
assigning the forming device to the fourth of the at least three star wheels.

8. The method of making the double walled cup according to claim 1, further including:
affixing at least one of the at least three star wheels to the machine frame in an easily exchangeable manner; and
providing easily releasable means for connection with a drive.

9. The method of making the double walled cup according to claim 1, further including:
supporting the at least three star wheels on the vertical wall in an overhanging manner.

10. The method of making the double walled cup according to claim 1, wherein:
the machine frame includes a base and the vertical wall is oriented transversely relative to the base, the at least three star wheels being supported on the vertical wall so as to be spaced vertically upward from the base.

11. The method of making the double walled cup according to claim 1, further including:
a drive connected to the horizontal drive shafts for effecting rotation of the at least three star wheels, the vertical wall having a first side disposed adjacent the at least three star wheels and a second side facing away from the first side, the drive being disposed on the second side of the vertical wall such that the vertical wall is interposed between the drive and the at least three star wheels.

12. The method of making the double walled cup according to claim 11, wherein:
each of the drive shafts is connected to the drive by a quick-action coupling member to permit ready removal of the respective one of the at least three star wheels from the machine frame.

13. The method of making the double walled cup according to claim 1, further including:
a plurality of processing stations disposed adjacent the first of the at least three star wheels, the first of the at least three star wheels being rotatable to sequentially position each mandrel at an appropriate one of the processing stations, and a separating device disposed adjacent the first of the at least three star wheels for feeding the flat-lying blank from a stack of blanks to one of the mandrels when positioned at an initial one of the processing stations, a subsequent one of the processing stations being configured to effect wrapping of the flat-lying blank around the one of the mandrels after the one of the mandrels leaves the initial one of the processing stations to form the sleeve, and a final one of the processing stations being configured to effect transfer of the sleeve from the one of the mandrels to the second of the at least three star wheels.

14. The method of making the double walled cup according to claim 13, further including:

a plurality of second processing stations disposed adjacent the second of the at least three star wheels, the second of the at least three star wheels including a plurality of hollow mandrels and being rotatable to sequentially position each hollow mandrel at an appropriate one of the second processing stations of the second of the at least three star wheels, each hollow mandrel being configured for receiving therein the sleeve transferred from the final one of the processing stations of the first of the at least three star wheels, and the third of at least three star wheels disposed adjacent the second of the at least three star wheels for transferring the cup into the sleeve located within one of the hollow mandrels when positioned at an initial one of the second processing stations of the second of the at least three star wheels, a subsequent one of the second processing stations of the second of the at least three star wheels being configured to join the sleeve located within the one hollow mandrel to the cup after the one hollow mandrel leaves the initial one of the second processing stations associated with the second of the at least three star wheels to form the cup, and a final one of the second processing stations associated with the second of the at least three star wheels being configured to effect transfer of the cup from the one hollow mandrel from the second of the at least three star wheels.

15. The method of making the double walled cup according to claim 14, further including:

a plurality of third processing stations disposed adjacent the third of the at least three star wheels, the third of the at least three star wheels including a plurality of mandrels and being rotatable to sequentially position each mandrel of the third of the at least three star wheels at an appropriate one of the third processing stations associated with the third of the at least three star wheels, and an inner cup magazine disposed adjacent the third of the at least three star wheels for feeding the cup to one of the mandrels of the third of the at least three star wheels when positioned at an initial ore of the third processing stations of the third of the at least three star wheels, a subsequent one of the third processing stations of the third of the at least three star wheels being configured to form a rib on the cup positioned on the one mandrel of the third of the at least three star wheels after the one mandrel of the third of the at least three star wheels leaves the initial one of the third processing stations of the third of the at least three star wheels to allow a finished cup product to be stacked, and a final one of the third processing stations associated with the third of the at least three star wheels being configured to effect transfer of the cup from the one mandrel of the third of the at least three star wheels to the initial one of the third processing stations of the second of the at least three star wheels.

16. The method of making the double walled cup according to claim 15, further including:

a fourth of the at least three star wheels disposed downstream of the second of the at least three star wheels and a processing station disposed adjacent the fourth of the at least three star wheels, the fourth of the at least three star wheels including a plurality of conical mandrels and the fourth of the at least three star wheels being rotatable to sequentially position each conical mandrel of the fourth of the at least three star wheels at the processing station associated with the fourth of the at least three star wheels, each conical mandrel of the fourth of the at least three star wheels being configured for receiving thereon the cup transferred from the final one of the third processing stations of the second of the at least three star wheels, and a forming device disposed adjacent the fourth of the at least three star wheels for widening a lower skirt of the cup positioned on one of the mandrels of the fourth of the at least three star wheels when positioned at the processing station of the fourth of the at least three star wheels to assist in stacking a plurality of the finished cup products.

* * * * *